United States Patent [19]

Eckert et al.

[11] Patent Number: 4,930,632

[45] Date of Patent: Jun. 5, 1990

[54] HAZARDOUS LIQUID CONTAINMENT TRAY

[76] Inventors: Robert L. Eckert, 11231 Foster Road, Los Alamitos, Calif. 90720; Don C. Atkins, 11282 Foster Road, Los Alamitos, Calif. 90720; Lee Sechler, 15111 Bushard #45, Westminister, Calif. 92683

[21] Appl. No.: 279,876

[22] Filed: Dec. 5, 1988

[51] Int. Cl.[5] ..... B65D 85/62; B65D 21/02; B65D 19/26

[52] U.S. Cl. ..... 206/386; 206/518; 206/596; 206/599; 206/520; 220/1.5; 220/1 C; 108/53.3; 108/55.1; 108/901

[58] Field of Search ..... 220/1 C, 1.5, 69; 206/386, 596, 597, 598, 599, 600, 501, 514, 518, 520; 108/55.1, 53.1, 53.3, 53.5, 55.1, 55.3, 55.5, 56.1, 56.3

[56] References Cited

U.S. PATENT DOCUMENTS

| | | | |
|---|---|---|---|
| 3,480,178 | 11/1969 | Morgan | 206/520 |
| 3,659,741 | 5/1972 | Corelli | 206/518 |
| 3,776,435 | 12/1973 | Smith | 206/518 |
| 3,944,070 | 3/1976 | Cardwell | 206/596 |
| 3,961,707 | 6/1976 | Lehr et al. . | |
| 3,968,895 | 7/1976 | Burnes | 220/1.5 |
| 3,999,653 | 12/1976 | Haigh et al. . | |
| 4,007,961 | 2/1977 | Fowler | 108/55.1 |
| 4,361,232 | 11/1982 | Olmsted . | |
| 4,426,015 | 1/1984 | Preston et al. . | |
| 4,480,748 | 11/1984 | Wind . | |
| 4,527,707 | 7/1985 | Heymann | 220/1 C |
| 4,550,830 | 11/1985 | Shuert . | |
| 4,580,680 | 4/1986 | Wind . | |
| 4,585,143 | 4/1986 | Fremow et al. . | |
| 4,643,314 | 2/1987 | Kidd . | |
| 4,653,651 | 3/1987 | Flum | 108/53.1 |
| 4,667,823 | 5/1987 | Wolfe | 206/597 |
| 4,675,373 | 6/1987 | Schneider . | |

*Primary Examiner*—George E. Lowrance

*Attorney, Agent, or Firm*—Plante, Strauss, Vanderburgh and Connors

[57] ABSTRACT

There is disclosed a containment tray which is formed of plastic which is molded into a tray having upright perimeter walls and a bottom wall having transverse channels in its undersurface for receiving the conventional arms of a forklift or pallet jack. The tray can be formed by vacuum thermal forming, in which case it is used in combination with a platform insert formed by a pair of beams which are received within the tray and which support transverse rails thereby forming an upper platform. Alternatively, the tray can be rotationally molded and the raised platform can be molded into the tray in the form of a plurality of upstanding plugs. In either embodiment, the upper planar surface of the raised platform is positioned above the level of the upper edges of the side walls of the tray whereby a conventional forklift can deposit loads of containers mounted on standard wooden pallets onto the raised platform of the tray, and remove those pallets, when desired.

10 Claims, 5 Drawing Sheets

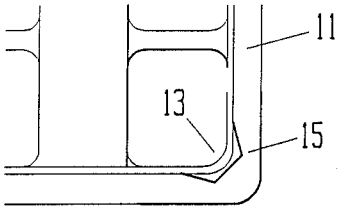
FIGURE 8
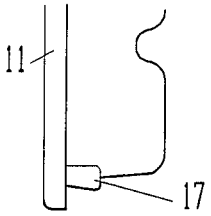
FIGURE 9
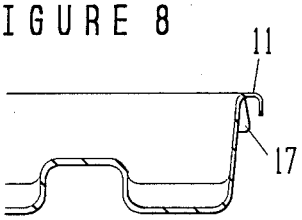
FIGURE 10
FIGURE 11
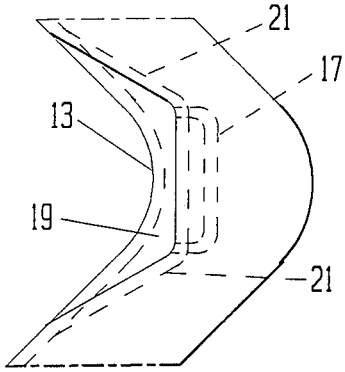
FIGURE 11 A
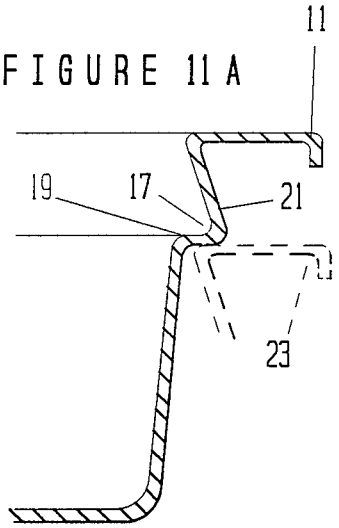

HAZARDOUS LIQUID CONTAINMENT TRAY

BACKGROUND OF THE INVENTION

1. Field of Invention

This invention relates to a containment device and, in particular, to a tray for containment of hazardous chemicals which may be spilled from containers which are customarily shipped and handled on pallets.

2. Brief Statement of the Prior Art

The increasing concern over protection of the environment and public health has focused attention on the safe storage and handling of hazardous chemicals. Of particular concern are hazardous chemicals which are often stored and handled in drums such as the ubiquitous steel or plastic barrel. Unintentional and uncontrolled leakage of such chemicals to the soil presents a hazard to the environment and to public health and often requires clean up efforts having astronomical costs. Accordingly, a need exists for the safe handling and storage of such chemicals by use of a containment device that can be used without compromising the normal storage and handling techniques used for such materials.

Various prior investigators have suggested different approaches or solutions to this problem. Examples of such are a product known as the Safe-T-Pallet which has a containment tray with a top platform which is used in lieu of a conventional pallet. Another commercially available device is known as the Orange Bin and comprises a large bin with a removable cylindrical liner within which individual drums of hazardous chemicals can be placed.

The difficulty with these approaches is that they compromise the conventional storage and handling of hazardous drums and containers which are commonly stored and handled while mounted on standard wooden pallets, thereby permitting movement of the materials using a conventional forklift.

U.S. Pat. No. 4,361,232 discloses a metal pan which is placed over a conventional pallet and is used for holding hazardous materials. The patented invention likewise compromises the conventional forklift handling of palletized loads of hazardous chemicals.

U.S. Pat. No. 4,643,314 discloses a plastic, pallet type container which is used in lieu of a standard wood pallet. This patent does not have any disclosure of a containment tray for hazardous chemicals. Various other patents disclose plastic pallets which are intended as substitutes for the conventional wood pallet. These include U.S. Pat. No. 4,480,748, 4,550,830 and 4,676,373. Most of these patents disclose plastic pallets which are offered as substitutes for the conventional wood pallet. A containment device for hazardous chemicals which does not compromise the conventional storage and handling of palletized loads of hazardous chemicals has not previously been provided.

BRIEF STATEMENT OF THE INVENTION

This invention includes a containment tray which is formed by molding of plastic into a tray having upright perimeter walls and a bottom wall having transverse channels molded into its undersurface for receiving the conventional arms of a forklift. The tray can be formed by vacuum thermal forming, in which case it is used in combination with a platform insert formed by a pair of beams which are received within the tray and which support transverse rails thereby forming an upper platform. Alternatively, the tray can be rotationally molded and the raised platform can be molded into the tray in the form of a plurality of upstanding plugs. In either embodiment, the upper planar surface of the raised platform is positioned above the level of the upper edges of the side walls of the tray whereby a conventional forklift can deposit loads of containers mounted on standard wooden pallets onto the raised platform of the tray, and remove those pallets, when desired.

BRIEF DESCRIPTION OF THE DRAWINGS

The invention will be described with reference to the FIGURES of which:

FIGS. 8, 9 and 10 disclose a preferred feature to provide nesting of the trays;

FIGS. 11 and 11A are plan and sectional views of a corner of the tray shown in FIGS. 8–10;

DESCRIPTION OF PREFERRED EMBODIMENT

Figure 1:
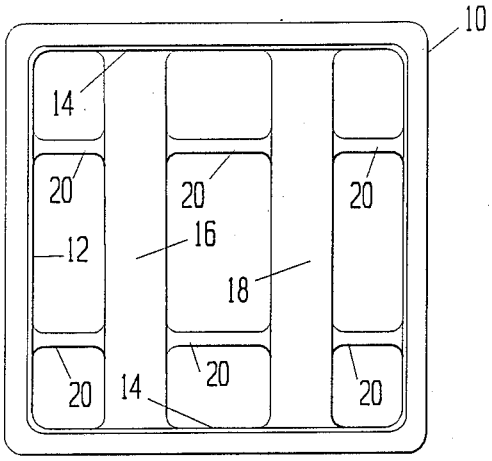
FIG. 1 is a top plan view of the containment tray of the invention.
Figure 3:
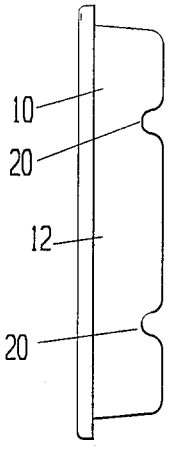
FIG. 3 is a side view of the containment tray.
Figure 2:
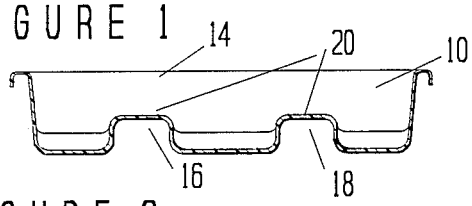
FIG. 2 is a elevational sectional view of the containment tray along line 2—2'.

Referring now to FIG. 1, the containment tray 10 of the invention is a relatively shallow tray of a substantial expanse or area. The tray 10 has peripheral side walls 12 and 14 which are inclined upwardly, preferably at a slight outward angular deflection, e.g., at from 3–10 degrees, preferably about 5 degrees. This outward angular deflection of the trays increases the open surface area for catching or retaining spills and permits the unused containment trays to be stacked in a nested array.

The containment tray is formed using conventional thermal forming or vacuum forming of sheet plastic materials, or with rotational molding. When thermal or vacuum molding is used, the tray is fabricated preferably of sheet plastic having a thickness of from 0.2 to about 0.5 inch, preferably about 0.375 inch. Suitable plastics for the fabrication include polyolefins such as high density polyethylene, polypropylene, halogenated hydrocarbons, polyfluorocarbons, vinyl compounds such as polyvinyl chloride, etc.

The base of the containment tray has at least a pair of transverse channels 16 and 18 which are molded into its undersurface. These channels have a sufficient width, and are spaced apart the appropriate distance to receive the arms of a conventional pallet jack or forklift. Typically, the channels have a width from about 8 to about 10 inches, preferably about 9 inches and are spaced apart from 21 to about 23 inches on centers. The channels thus molded into the base of the containment tray serve for handling of the tray and additionally provide a stiffness or rigidity to the tray. Additional reinforcement ribs 20 are provided orthogonal to the aforementioned channels 16 and 18. These reinforcement ribs 20 are molded as indentations in the bottom wall of the tray.

Figure 4:
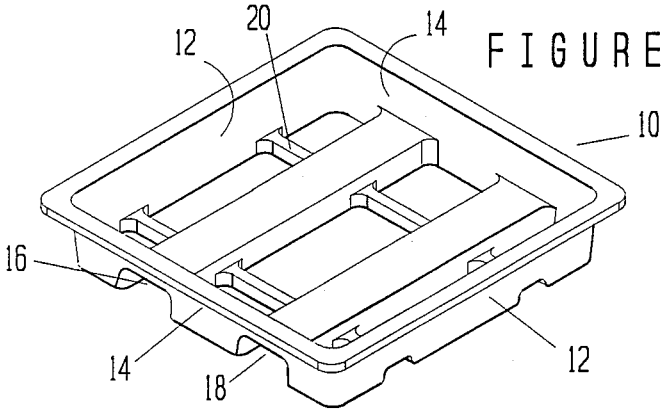
FIG. 4 is a perspective view of the tray of the invention.

Referring now to FIG. 4, the containment tray is illustrated in perspective view. As there illustrated, the channels 16 and 18 are open externally to permit free access for the fork of a conventional forklift or pallet jack. The containment tray has a sufficient expanse that it will encompass the span or aerial dimensions of a conventional wood pallet. Typically, the dimension of the containment tray is 54"×54"and is intended for use with a conventional wooden pallet having dimensions of 48"×48". The dimensions of the tray can be changed as desired to accommodate other sized pallets. Generally, the length and width of the containment tray should be from 10 to about 25 percent greater than the corresponding length and width dimensions of the pallet with which it is used to avoid any spillage of hazardous chemicals beyond the peripheral extremities of the containment tray.

Figure 5:
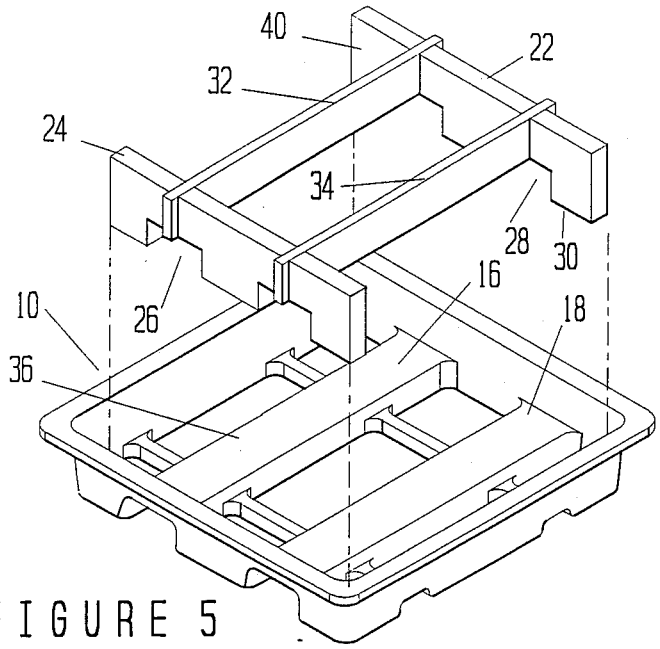
FIG. 5 is an exploded perspective view of the platform member and the tray of the invention.

FIG. 5 illustrates the platform member 40 which is used in combination with the containment tray. This platform member has at least a pair of support beams 22 and 24 which can be formed of wood or other suitable material. The beams 22 and 24 have a pair of notches 26 and 28 along their lower edges 30 and these notches are sized sufficiently and spaced apart the appropriate distance to permit the beam to be received within the containment tray, resting on the bottom wall of the tray and over its associated transverse channels 16 and 18. A pair of transverse rails 32 and 34 are mounted on the beams 22 and 24 of the platform member, and these beams also rest on the top surface 36 of the channels 16 and 18. The upper edges of the rails 32 and 34 and the beams 22 and 24 are in a common plane, thereby forming a substantially planar support platform.

Figure 6:
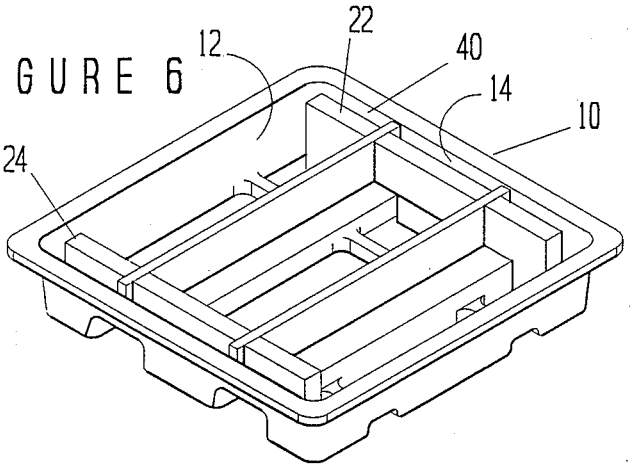
FIG. 6 is a perspective view of the assembly of the platform member and containment tray.

Referring now to FIG. 6, the platform member 40 is shown in its assembled location within the containment tray 10. The platform member 40 is positioned within the containment tray 10 with the beams 22 and 24 spanning the channels 16 and 18 which are molded in the bottom wall of the containment tray 10. The height of the platform member is sufficient whereby the planar platform formed at its upper edge is supported vertically above the upper edges of the side walls 12 and 14 of the containment tray 10. This platform provides the base for receiving and supporting palletized loads of hazardous chemicals.

The tray and platform assembly provide adequate load support for any conventional palletized load. When the tray rests on the ground or floor, as shown in FIG. 6, the support beams 22 and 24 of the platform 40 react the load. When the tray is lifted or moved with a forklift or pallet jack, the load is transferred to the fork members of the lift through the channels 16 and 18, and the transverse rails 32 and 34 thus react the load.

Figure 7:
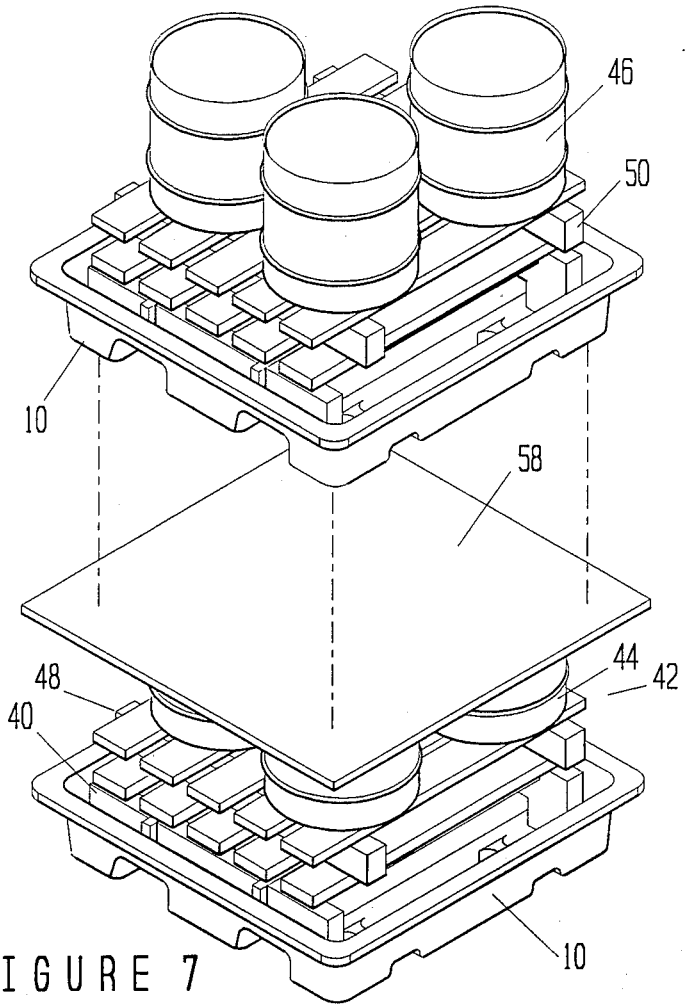
FIG. 7 is a perspective view of a palletized load of hazardous chemicals mounted on the containment device of the invention, with an exploded view showing stacking of the trays and pallets.

Referring now to FIG. 7, there is illustrated a palletized load 42 of hazardous chemicals, contained within a plurality of conventional drums 44, which are mounted on the platform 40 of the containment device. The illustration shows two palletized loads 42 and 46 with the upper load in a position similar to its position when being stacked with a conventional fork lift. The containment devices shown in FIG. 6 can be readily stacked on each other as each loaded containment device can be picked up, hoisted and transported with a conventional forklift. When these containment devices are stacked in the manner illustrated in FIG. 7, it is preferred to provide additional bearing support by placing a plate 58, commonly a plywood board having a thickness from 0.5 to about 1 inch, between the lower palletized load 42 and the upper, loaded containment device 10.

Each pallet 48 and 50 is a conventional wood pallet as used throughout the chemical industry. Typically this pallet has dimensions of 48" in length and 48" in width and is formed with three transverse wood beams 52 and 54, typically 2"×4" and a plurality of transverse wood boards 56, typically 1"×6" that are attached along the bottom and top edges of the support beams. Since the support platform of the assembly is located vertically above the upper edges of the side walls 12 and 14 of the containment tray 10, these side walls do not obstruct access to the storage platform of the support member 40. Accordingly, a conventional forklift can be used to deposit and remove palletized loads onto each storage platform. Since the containment tray 10 spans an area which extends approximately 6–12 inches beyond the peripheral extremities of the pallet, there is no danger that any leakage of chemicals from the drums will escape the containment tray. It is thus apparent that the containment device of the invention does not, in any way, compromise the conventional storing and handling of containers of hazardous chemicals. Instead, the containment device can be used with conventional forklifts and pallet jacks, permitting the use of conventional handling of palletized loads of materials.

The platform member can be provided with joints permitting its assembly and disassembly. Additionally, these platform members can simply be stacked in vertical columns thereby conserving floor space in a warehouse.

The containment tray should have a capacity from about 100 to about 200 percent of the volume of the largest size vessel or container that is stored on the containment device. As these containers are conventional drums or barrels which typically have a maximum capacity of 55 gallons, the containment device thus is provided with a contained volume of about 83 gallons. This can be achieved in a structure of the aforementioned length and width dimensions and with a vertical side wall of from 6 to about 10 inches.

The containment device of the invention can be stored when not is use, as the containment trays can be stacked in a nested array thereby providing a very compact storage. For this purpose, it is preferred to provide a nesting support with each tray which will prevent locking of the stacked trays. A suitable nesting support is shown in FIGS. 8–11. As there illustrated, each inside corner 13 of the tray 11 has a nesting support 15. The nesting support comprises an outwardly directed pocket 17 at each corner which is located adjacent the upper edge of the tray. As shown in FIG. 11, each pocket 17 has a horizontal base 19 and inwardly and upwardly inclined side walls 21. The pockets provide corner rests for each tray 11 which rests on the upper lip of the subjacent tray 23. In this manner, the trays can be nested without seating so tightly together that they will resist separation.

Figure 12:
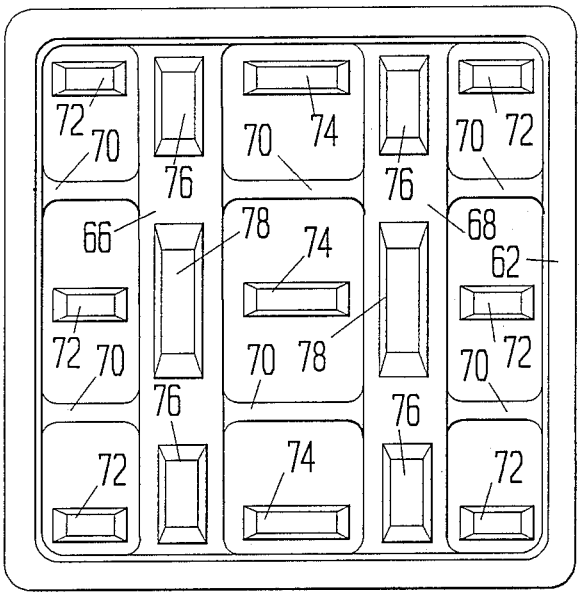
FIG. 12 is a top plan view of the rotationally molded containment tray of the invention.
Figure 13:
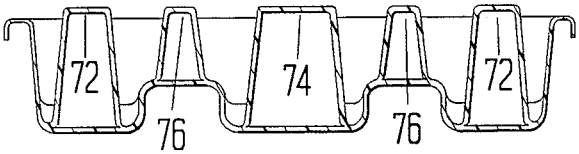
FIG. 13 is a elevational sectional view of the containment tray of FIG. 12 along line 13—13.

Referring now to FIGS. 12 and 13, there is illustrated a rotationally molded tray 60 which has an outer peripheral lip 62 and channels 66 and 68. Additionally, a plurality of support lugs are formed within the tray. These support lugs are arranged in each of the cavities formed between the channels and transverse ribs 70 which are molded in the bottom surface of the tray. A total of six identically shaped lateral lugs 72 and three central lugs 74 are provided, all oriented in a common direction. A plurality of four short lugs 76 are also provided, one on each end of the channels 16 and 18. Two center lugs 78 are formed on the top center of each channel 16 and 18. As shown in FIG. 13, the lugs are formed as upstanding, hollow form members which are integral with the bottom surface of the tray. All of the lugs have a top horizontal surface, and all of these top surfaces lie in a common horizontal plane, thereby defining a single planar support surface lying on the common plane. This plane is located slightly above the top edges of the tray, and provides support for conventional pallets which can be rested on the lugs, in the same manner as described for the platform member shown with the tray of FIGS. 1–4.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims.

We claim:

1. A hazardous liquid containment structure comprising the combination of:

a. a tray having:

(1) a base;

(2) substantially vertical side walls entirely surrounding the base to form a containment pan with their upper edges lying in a common plane;

(3) a pair of parallel, transverse grooves formed by indentations molded in the bottom wall of said base, spaced apart a sufficient distance and of a sufficient width to receive therein the fork members of a fork lift; and (4) a plurality of reinforcement ribs transverse to said grooves; and b. a pallet support member resting within said tray and comprising:

(1) at least a pair of spaced-apart beam members having a vertical height at least equal to the height of said vertical walls; and (2) a plurality of transverse rails supported by and attached to said beam members, thereby forming a platform to support a storage pallet above said plane.

2. The structure of claim 1 wherein said beam members have spaced-apart notches along their lower edges to receive said grooves of said base.

3. The structure of claim 1 in further combination with a pallet received and resting on the upper edges of said beams entirely above the upper edges of said side wall of said tray.

4. The structure of claim 3 in further combination with at least one container of a hazardous liquid resting on the upper surface of said pallet.

5. The structure of claim 1 wherein said tray is formed by thermoforming of sheet plastic.

6. The structure of claim 1 wherein said tray has a storage capacity from 55 to 100 gallons.

7. The structure of claim 1 wherein said side walls are slightly tapered upwardly and outwardly, whereby a plurality of said trays can be stacked in a nested array.

8. The structure of claim 6 wherein said side walls are inclined outwardly at an angle from 3 to about 10 degrees from the vertical.

9. The structure of claim 1 wherein said side walls have an coextensive, upper outwardly directed lip having a downwardly curled edge.

10. The structure of claim 1 wherein said reinforcement ribs comprise inward indentations molded into said bottom wall of said base.

* * * * *